US011469484B2

(12) United States Patent
Ding et al.

(10) Patent No.: US 11,469,484 B2
(45) Date of Patent: Oct. 11, 2022

(54) CIRCUIT STRUCTURE

(71) Applicant: INDUSTRIAL TECHNOLOGY RESEARCH INSTITUTE, Hsinchu (TW)

(72) Inventors: Hsiang En Ding, Tainan (TW); Shih-Hsien Wu, Taoyuan (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 16/821,283

(22) Filed: Mar. 17, 2020

(65) Prior Publication Data

US 2021/0203052 A1 Jul. 1, 2021

(30) Foreign Application Priority Data

Dec. 31, 2019 (TW) ..... 108148613

(51) Int. Cl.
*H01P 3/08* (2006.01)
*H01P 11/00* (2006.01)

(52) U.S. Cl.
CPC ..... *H01P 3/081* (2013.01); *H01P 11/003* (2013.01)

(58) Field of Classification Search
CPC ..... H01P 3/081; H01P 11/003
See application file for complete search history.

(56) References Cited

U.S. PATENT DOCUMENTS 5,757,252 A * 5/1998 Cho ..... H01L 23/66 174/262
8,258,892 B2 9/2012 Abhari et al.
(Continued)

FOREIGN PATENT DOCUMENTS

CN 102509833 B 9/2013
CN 104735907 A 6/2015
(Continued)

OTHER PUBLICATIONS

CN Offie Action in Application No. 202010084251.8 dated Nov. 3, 2021.

*Primary Examiner* — Samuel S Outten
(74) *Attorney, Agent, or Firm* — Maschoff Brennan

(57) ABSTRACT

A circuit structure includes a substrate integrated waveguide, a substrate disposed on the substrate integrated waveguide, a waveguide signal feeding element and a ring-shaped conductive element. The substrate integrated waveguide includes another substrate having a waveguide transmitting region, two conductive layers disposed on this substrate and covering the waveguide transmitting region, and at least one waveguide conductive element passing through this substrate and electrically connected to the two conductive layers. The at least one waveguide conductive element surrounds the waveguide transmitting region. One of the conductive layers is located between the two substrates. The waveguide signal feeding element passes through one substrate and one conductive layer between the substrates, and the waveguide signal feeding element extends to the waveguide transmitting region. The waveguide signal feeding element is electrically insulated from one conductive layer. The ring-shaped conductive element is disposed in one substrate and surrounds the waveguide signal feeding element.

13 Claims, 10 Drawing Sheets

(56) References Cited

U.S. PATENT DOCUMENTS

| | | | | |
|---|---|---|---|---|
| 9,837,695 | B2 | 12/2017 | Gregoire et al. | |
| 10,170,815 | B2 | 1/2019 | Uemichi | |
| 2004/0069529 | A1* | 4/2004 | Oggioni | H05K 1/115 174/262 |
| 2011/0117836 | A1 | 5/2011 | Zhang et al. | |
| 2011/0267152 | A1* | 11/2011 | Lee | H01P 5/103 333/26 |
| 2015/0181693 | A1 | 6/2015 | Wu et al. | |
| 2016/0174360 | A1 | 6/2016 | Hsu et al. | |
| 2017/0019994 | A1 | 1/2017 | Wu | |

FOREIGN PATENT DOCUMENTS

| | | | |
|---|---|---|---|
| CN | 105764235 | A | 7/2016 |
| CN | 106356349 | A | 1/2017 |
| CN | 105680133 | B | 8/2018 |
| CN | 108448218 | A | 8/2018 |
| TW | I335101 | B | 12/2010 |
| TW | I520289 | B | 2/2016 |
| TW | M582242 | U | 8/2019 |

* cited by examiner

CIRCUIT STRUCTURE

CROSS-REFERENCE TO RELATED APPLICATIONS

This non-provisional application claims priority under 35 U.S.C. § 119(a) on Patent Application No(s). 108148613 filed in Taiwan, R.O.C. on Dec. 31, 2019, the entire contents of which are hereby incorporated by reference.

BACKGROUND

In a circuit structure, a substrate integrated waveguide or a microstrip may be used for transmitting electromagnetic wave signals. The substrate integrated waveguide is a kind of waveguide which transmits the electromagnetic wave signals inside a substrate. The microstrip is a kind of transmitting line which transmits the electromagnetic wave signals with a conductive line on a ground layer. Compared to the microstrip, due to the usage of transmitting higher power signals, the substrate integrated waveguide enjoys less transmission loss, and less interference between the substrate integrated waveguide and external noises is observed.

When the substrate integrated waveguide is used for transmitting signals, a conductive via is provided to extend into the substrate integrated waveguide, and the signals are fed from the conductive via into the substrate integrated waveguide.

SUMMARY

One embodiment of the disclosure provides a circuit structure including a substrate integrated waveguide having a first substrate, a first conductive layer, a second conductive layer, and at least one waveguide conductive element, a second substrate, a waveguide signal feeding element, and a ring-shaped conductive element. The first substrate has a waveguide transmitting region. The first conductive layer and the second conductive layer are disposed on opposite surfaces of the first substrate, respectively, and cover the waveguide transmitting region. The at least one waveguide conductive element passes through the first substrate and electrically connected to the first conductive layer and the second conductive layer. The at least one waveguide conductive element surrounds the waveguide transmitting region. The second substrate is disposed on the substrate integrated waveguide. The second conductive layer is located between the first substrate and the second substrate. The waveguide signal feeding element passes through the second substrate and the second conductive layer and extends to the waveguide transmitting region of the first substrate. The waveguide signal feeding element is electrically insulated from the second conductive layer. The ring-shaped conductive element is disposed in the second substrate and surrounds the waveguide signal feeding element.

DETAILED DESCRIPTION

Features and advantages of embodiments of the disclosure are described in the following detailed description, it allows the person skilled in the art to understand the technical contents of the embodiments of the disclosure and implement them, and the person skilled in the art can easily comprehend the purposes of the advantages of the disclosure. The following embodiments are further illustrating the perspective of the disclosure, but not intending to limit the disclosure.

The drawings may not be drawn to actual size or scale, some exaggerations may be necessary in order to emphasize basic structural relationships, while some are simplified for clarity of understanding, and the present disclosure is not limited thereto. It is allowed to have various adjustments under the spirit of the present disclosure. In the specification, the term "up", "top", "above", "down", "low", "left", "right", "front", "rear", and "back" about directions mentioned in the description of the embodiments and drawings are used for illustration, but not for limiting the disclosure.

Figure 1:
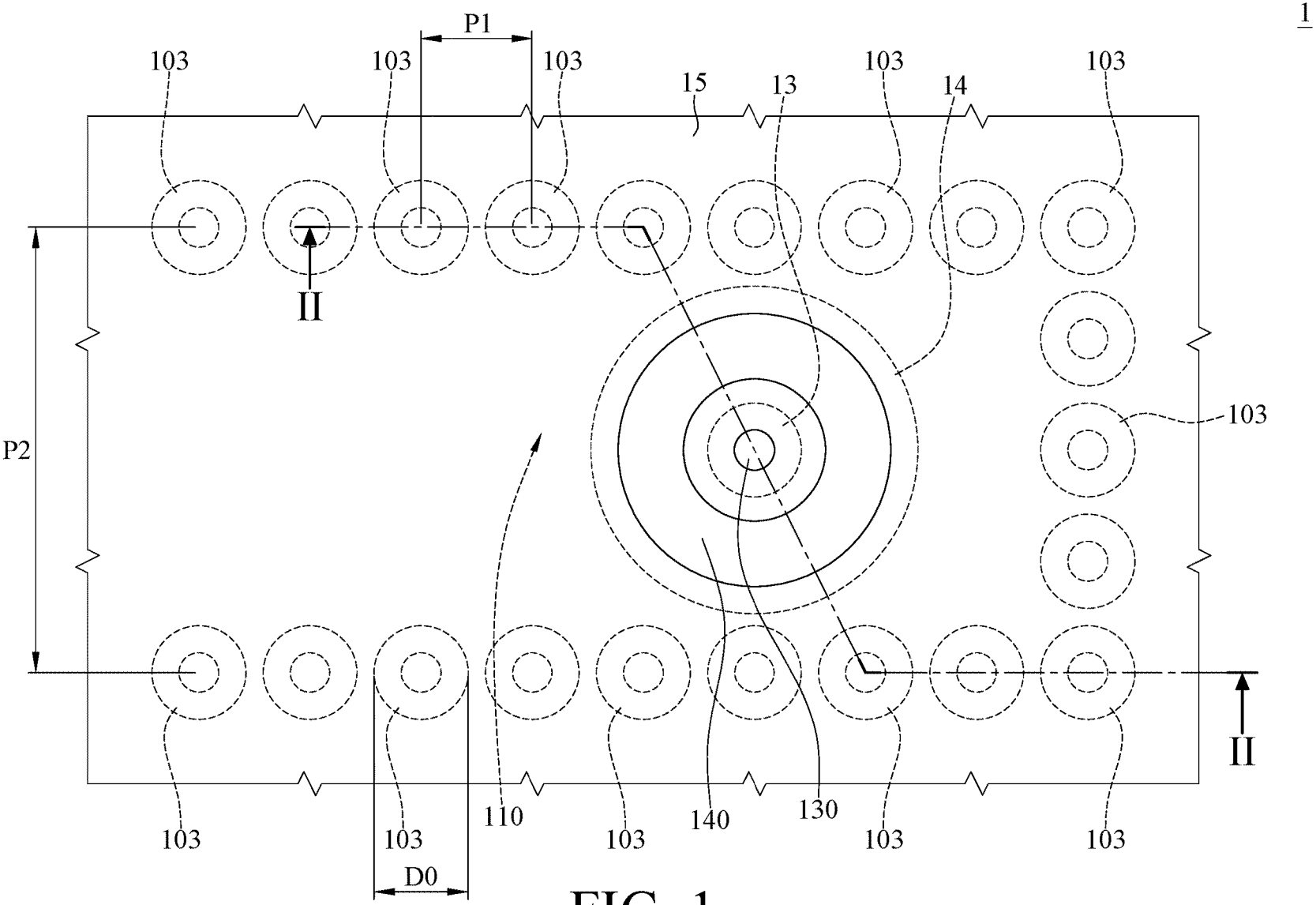
FIG. 1 is a top view of a circuit structure according to one embodiment of the disclosure.
Figure 2:
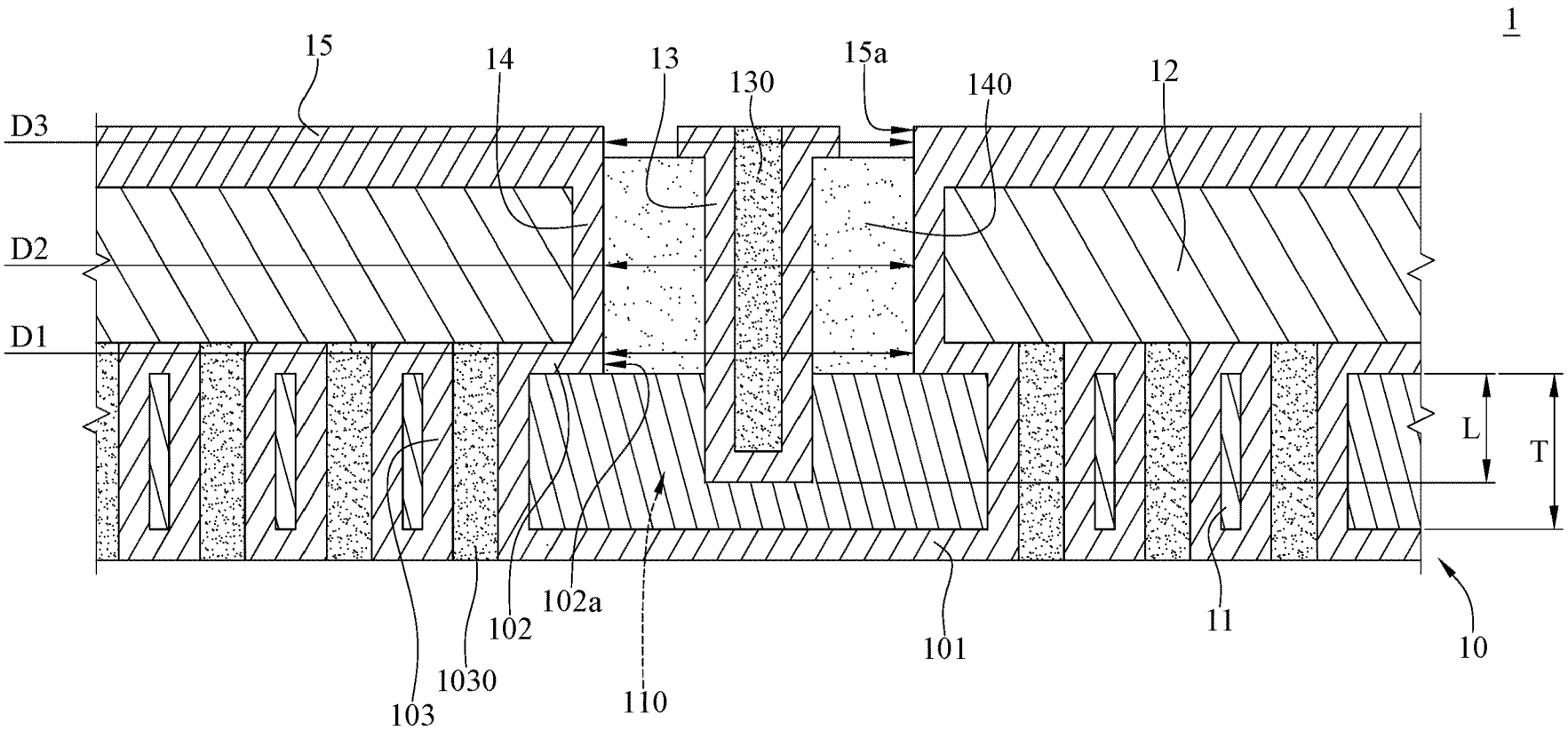
FIG. 2 is a cross-sectional view of the circuit structure in FIG. 1.

Please refer to FIGS. 1 and 2. FIG. 1 is a top view of a circuit structure according to one embodiment of the disclosure. FIG. 2 is a cross-sectional view of the circuit structure in FIG. 1.

In this embodiment, a circuit structure 1 includes a substrate integrated waveguide 10. The substrate integrated waveguide 10 includes a first substrate 11, a first conductive layer 101, a second conductive layer 102, and a plurality of waveguide conductive elements 103. The first substrate 11 has a waveguide transmitting region 110. The waveguide transmitting region 110 is configured for transmitting an electromagnetic wave. The first conductive layer 101 and the second conductive layer 102 are disposed on opposite sides of the first substrate 11, respectively, and the first conductive layer 101 and the second conductive layer 102 cover the waveguide transmitting region 110. The waveguide conductive elements 103 passes through the first substrate 11, and each waveguide conductive element 103 is electrically connected to the first conductive layer 101 and the second conductive layer 102. The waveguide conductive elements 103 together surround the waveguide transmitting region 110.

In this embodiment, each of the waveguide conductive elements 103 is a conductive pillar. The waveguide conductive elements 103 together surround the waveguide transmitting region 110 in a U-shaped arrangement. Most of the waveguide conductive elements 103 are spaced from each other by a first pitch P1 and together surround the waveguide transmitting region 110. A pair of the waveguide conductive elements 103 has a second pitch P2 therebetween. The first pitch P1 and the second pitch P2 are directed to a distance between centers of respective pairs of waveguide conductive elements 103. The second pitch P2 is larger than the first pitch P1. In some embodiments, an outer diameter D0 of the waveguide conductive element 103 is smaller than or equal to one fifth of a wavelength of transmitted signal. In some other embodiments, the first pitch P1 is smaller than or equal to twice the outer diameter D0 of the waveguide conductive element 103. In some embodiments, the second pitch P2 is larger than or equal to half of the wavelength of transmitted signal.

The present disclosure is not limited to the arrangement of the waveguide conductive elements 103 described in this embodiment. In another embodiment, all of the waveguide conductive elements may be also spaced from each other by the first pitch and together surround the waveguide transmitting region.

In another embodiment, the waveguide conductive elements are arranged at the periphery of the waveguide transmitting region in a double-line arrangement. Specifically, most of the waveguide conductive elements are spaced from each other by a first pitch. Two of the waveguide conductive elements, at opposite ends of the waveguide transmitting region, respectively, are spaced from each other by a second pitch different from the first pitch.

In another embodiment, a quantity of the waveguide conductive element may be also one. The waveguide conductive element is a conductive sheet. The waveguide conductive element surrounds the waveguide transmitting region in a U-shaped arrangement.

In another embodiment, a quantity of the waveguide conductive element may be also one. The waveguide conductive element is a conductive sheet. The waveguide conductive element entirely surrounds the waveguide transmitting region.

In another embodiment, a quantity of the waveguide conductive elements may be two. The waveguide conductive elements are two conductive sheets. The waveguide conductive elements together surround the waveguide transmitting region in a double-parallel-line arrangement.

In this embodiment, each of the waveguide conductive elements 103 is a hollow conductive pillar with a filler 1030 filled in the inside, but the present disclosure is not limited to the configuration of waveguide conductive element 103. In another embodiment, each of the waveguide conductive elements may be a solid conductive pillar.

In this embodiment, the circuit structure 1 further includes a second substrate 12, a waveguide signal feeding element 13, a ring-shaped conductive element 14, and a top conductive layer 15. The second substrate 12 is disposed on the substrate integrated waveguide 10, the second conductive layer 102 is located between the first substrate 11 and the second substrate 12. The waveguide signal feeding element 13 passes through the second substrate 12 and the second conductive layer 102 and extends to the waveguide transmitting region 110 of the first substrate 11. A portion of the waveguide signal feeding element 13 extending into the first substrate 11 has a length L, and the length L is smaller than the thickness of the first substrate 11. The second conductive layer 102 has an opening 102*a*. The waveguide signal feeding element 13 passes through the opening 102*a*. The waveguide signal feeding element 13 is electrically insulated from the second conductive layer 102. In this embodiment, the waveguide signal feeding element 13 is a hollow conductive pillar with a filler 130 filled inside, but the present disclosure is not limited thereto. In another embodiment, the waveguide signal feeding element may be a solid conductive pillar.

The ring-shaped conductive element 14 is disposed in the second substrate 12. The ring-shaped conductive element 14 passes through the second substrate 12 and entirely surrounds the waveguide signal feeding element 13. An inner diameter D1 of the opening 102*a* of the second conductive layer 102 is substantially equal to an inner diameter D2 of the ring-shaped conductive element 14. A portion of the dielectric component 140 is filled between the ring-shaped conductive element 14 and the waveguide signal feeding element 13, and another portion of the dielectric component 140 is filled between the second conductive layer 102 and the waveguide signal feeding element 13.

The ring-shaped conductive element 14 is electrically connected to the second conductive layer 102. The top conductive layer 15 is disposed on the second substrate 12. The second substrate 12 is located between the second conductive layer 102 and the top conductive layer 15. The top conductive layer 15 has an opening 15*a*. The waveguide signal feeding element 13 passes through the opening 15*a*. An inner diameter D3 of the opening 15*a* of the top conductive layer 15 is substantially equal to the inner diameter D2 of the ring-shaped conductive element 14. The top conductive layer 15 is electrically connected to the ring-shaped conductive element 14. The waveguide signal feeding element 13 is electrically insulated from the top conductive layer 15.

In this embodiment, the first substrate 11 has a first dielectric coefficient, and the second substrate 12 has a second dielectric coefficient. The first dielectric coefficient may be equal to the second dielectric coefficient, but the present disclosure is not limited thereto. In some embodiments, the first dielectric coefficient and the second dielectric coefficient may be different according to requirements. For example, a waveguide impedance is generated when a signal passes through the substrate integrated waveguide 10, and an equivalent impedance is generated when a signal passes through the waveguide signal feeding element 13 and is fed into the substrate integrated waveguide 10. Referring to the design of the circuit structure 1, a value of the waveguide impedance is adjustable by selecting the first substrate 11 having suitable first dielectric coefficient. Further, a value of the equivalent impedance is adjustable by selecting the second substrate 12 having suitable second dielectric coefficient as well as the dielectric component 140 having suitable dielectric coefficient. By adjusting the value of the equivalent impedance to be close to the value of the waveguide impedance, the equivalent impedance matches the waveguide impedance along a path where the signal passes through. Therefore, the signal is prevented from being excessively attenuated or distorted due to impedance mismatch, such that the signal strength and the signal accuracy of the signal transmission of the circuit structure 1 are improved.

When manufacturing the circuit structure 1, a commercially available double-sided copper-clad laminate may be used as the first substrate 11, the first conductive layer 101, and the second conductive layer 102 of the substrate integrated waveguide 10, but the present disclosure is not limited thereto. The plurality of the waveguide conductive elements 103 are formed according to a predetermined position of the waveguide transmitting region 110, so that the plurality of the waveguide conductive elements 103 are disposed on the periphery of the waveguide transmitting region 110, thereby forming the substrate integrated waveguide 10. Next, the second substrate 12 and the top conductive layer 15 are formed on the second conductive layer 102. A portion of the top conductive layer 15, a portion of the second substrate 12, and a portion of the second conductive layer 102 are removed at the predetermined position where the ring-shaped conductive element 14 will be formed. The ring-shaped conductive element 14 and the dielectric component 140 are further formed at the predetermined position. Further, the waveguide signal feeding element 13 and the filler 130 are formed at a position where the dielectric component 140 is located, and both the waveguide signal feeding element 13 and the filler 130 extend from the second substrate 12 to the first substrate 11. In addition, the top conductive layer 15 may be patterned according to requirements.

When using the circuit structure 1, the first conductive layer 101 and the second conductive layer 102 may be grounded. The waveguide conductive element 103, the ring-shaped conductive element 14, and the top conductive layer 15 may be also grounded because the waveguide conductive element 103, the ring-shaped conductive element 14, and the top conductive layer 15 are electrically connected to the first conductive layer 101 and the second conductive layer 102. When fed into the waveguide transmitting region 110 of the substrate integrated waveguide 10 by the waveguide signal feeding element 13, the signal to be transmitted is converted into an electromagnetic wave. In this embodiment, the grounded first conductive layer 101 and the second conductive layer 102 cover the waveguide transmitting region 110, and the grounded waveguide conductive elements 103 are arranged in a U-shape around the waveguide transmitting region 110 with any two of the waveguide conductive elements 103 spaced by first pitch P1 or second pitch P2. Therefore, the signal, which is converted into electromagnetic wave, is able to be transmitted in the waveguide transmitting region 110.

Figure 3:
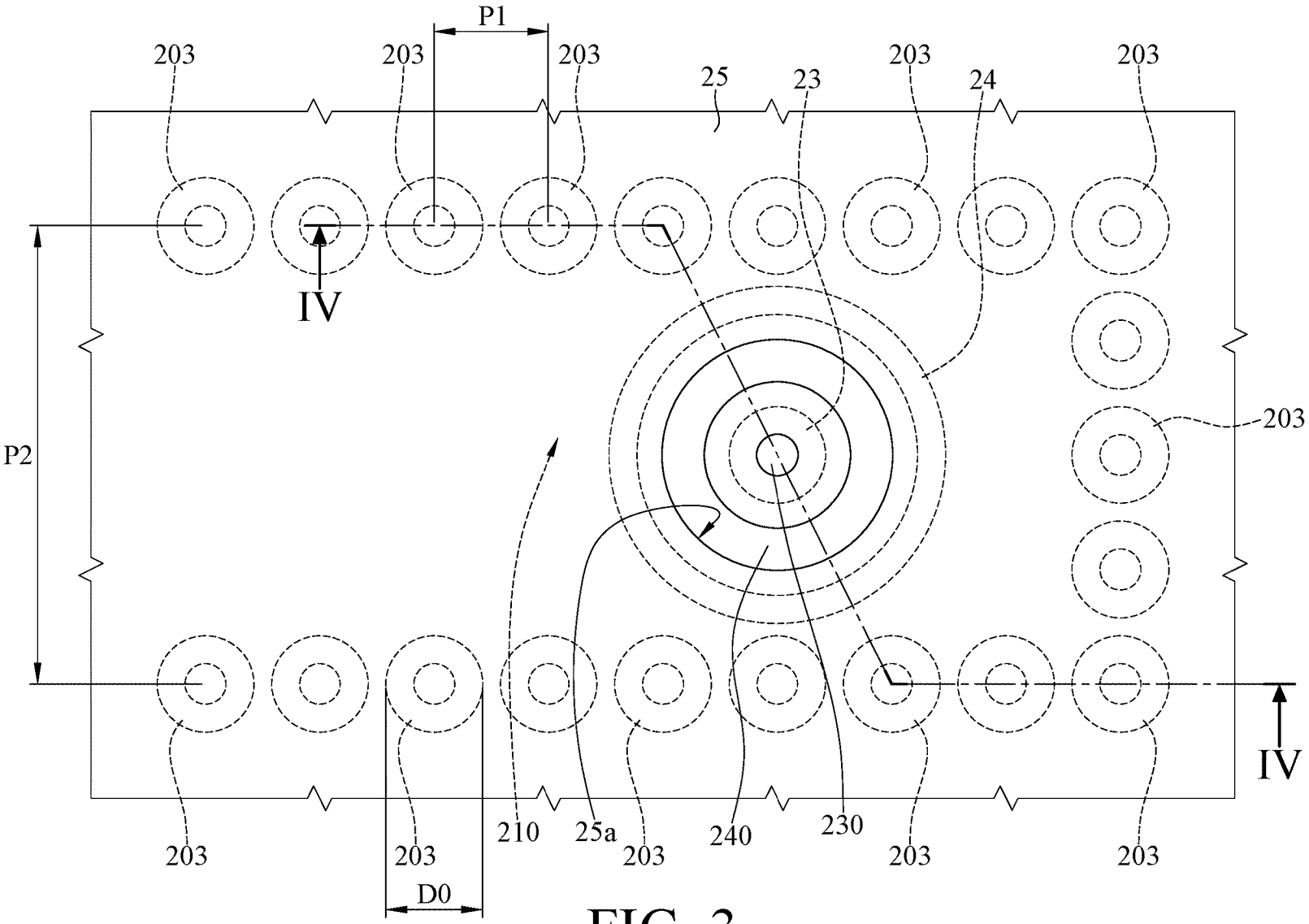
FIG. 3 is a top view of a circuit structure according to another embodiment of the disclosure.
Figure 4:
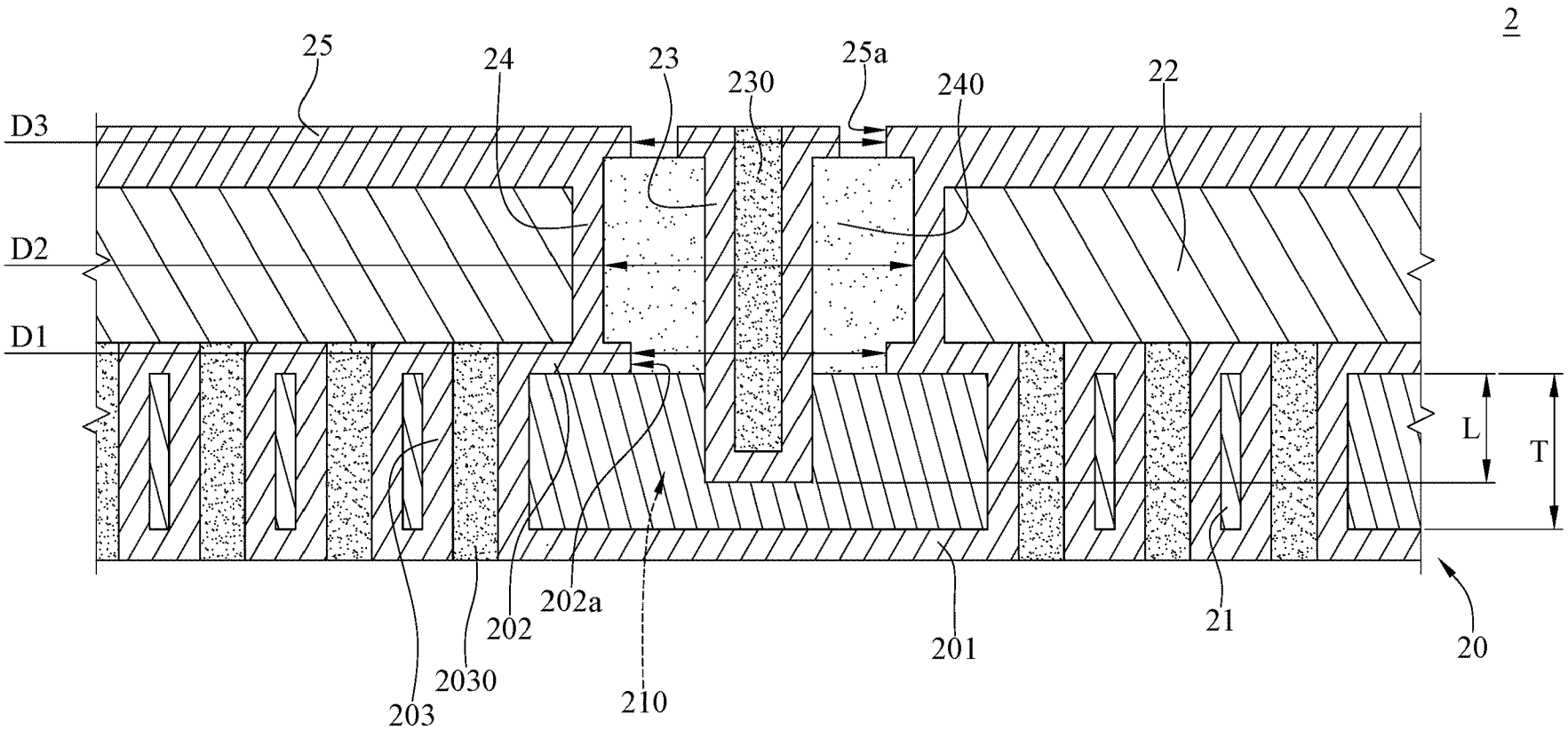
FIG. 4 is a cross-sectional view of the circuit structure in FIG. 3.

Please refer to FIGS. 3 and 4. FIG. 3 is a schematic top view of a circuit structure according to another embodiment of the disclosure. FIG. 4 is a schematic cross-sectional view of the circuit structure in FIG. 3.

In this embodiment, the circuit structure 2 includes a substrate integrated waveguide 20 having a first substrate 21, a first conductive layer 201, a second conductive layer 202, a plurality of waveguide conductive elements 203, and a plurality of fillers 2030, a second substrate 22, a waveguide signal feeding element 23, a filler 230, a ring-shaped conductive element 24, a dielectric component 240, and a top conductive layer 25. The first substrate 21 has a waveguide transmitting region 210. The waveguide conductive element 203 has an outer diameter D0. Each pair of the waveguide conductive elements 203 has a first pitch P1 or a second pitch P2 therebetween. A portion of the waveguide signal feeding element 23 extending into the first substrate 21 has a length L, and the length L is smaller than a thickness of the first substrate 21.

The circuit structure 2 in this embodiment as mentioned is similar to the circuit structure 1 shown in FIGS. 1 and 2, so that the similar content is omitted. The differences between the circuit structure 2 and the circuit structure 1 are as following.

In the circuit structure 2 of this embodiment, an inner diameter D1 of an opening 202*a* of the second conductive layer 202 is smaller than an inner diameter D2 of the ring-shaped conductive element 24. An inner diameter D3 of an opening 25*a* of the top conductive layer 25 is smaller than the inner diameter D2 of the ring-shaped conductive element 24.

A waveguide impedance is generated when a signal passes through the substrate integrated waveguide 20, and an equivalent impedance is generated when a signal passes through the waveguide signal feeding element 23 and is fed into the substrate integrated waveguide 20. A distance between the second conductive layer 202 and the waveguide signal feeding element 23, a distance between the top conductive layer 25 and the waveguide signal feeding element 23, and a distance between the ring-shaped conductive element 24 and the waveguide signal feeding element 23 have positive correlation with the equivalent impedance. Referring to the design of the circuit structure 2 without changing the sizes of the waveguide signal feeding element 23 and the ring-shaped conductive element 24, the distance between the waveguide signal feeding element 23 and the second conductive layer 202 is adjustable by changing the inner diameter D1 of the opening 202*a* of the second conductive layer 202, thereby adjusting a value of the equivalent impedance. Additionally, the distance between the waveguide signal feeding element 23 and the top conductive layer 25 is adjustable by changing the inner diameter D3 of the opening 25*a* of the top conductive layer 25, thereby adjusting the value of the equivalent impedance. By adjusting the value of the equivalent impedance to be close to the value of the waveguide impedance, the equivalent impedance matches the waveguide impedance along a path where the signal passes through. Therefore, the signal is prevented from being excessively attenuated or distorted due to impedance mismatch, such that the signal strength and the signal accuracy of the signal transmission of the circuit structure 2 are improved.

Figure 5:
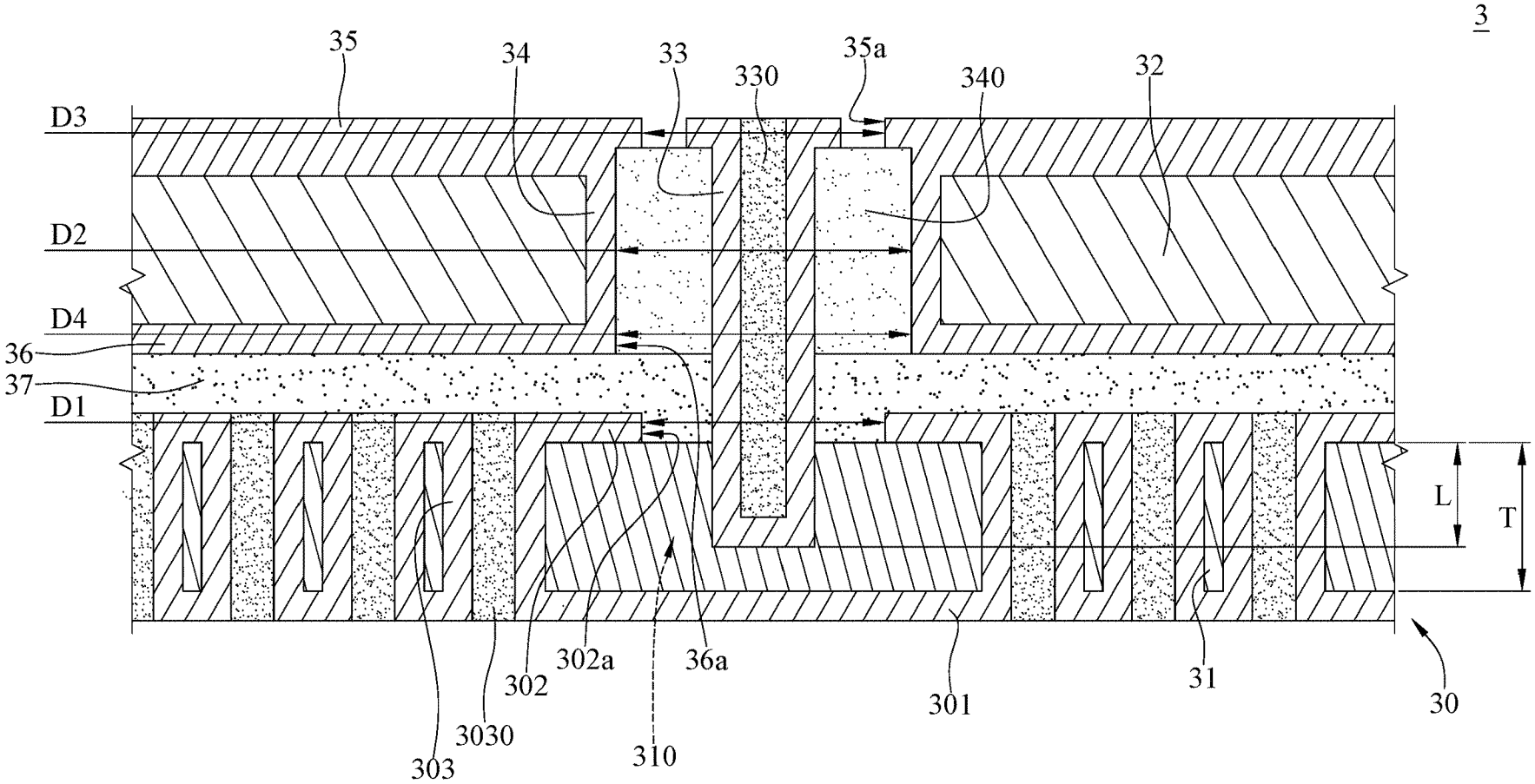
FIG. 5 is a top view of a circuit structure according to another embodiment of the disclosure.

Please refer to FIG. 5, which is a schematic top view of a circuit structure according to another embodiment of the disclosure.

In this embodiment, the circuit structure 3 includes a substrate integrated waveguide 30 having a first substrate 31, a first conductive layer 301, a second conductive layer 302, a plurality of waveguide conductive elements 303, and a plurality of fillers 3030, a second substrate 32, a waveguide signal feeding element 33, a filler 330, a ring-shaped conductive element 34, a dielectric component 340, and a top conductive layer 35. The first substrate 31 has a waveguide transmitting region 310. A portion of the waveguide signal feeding element 33 extending into the first substrate 31 has a length L, and the length L is smaller than a thickness of the first substrate 31.

The circuit structure 3 in this embodiment as mentioned is similar to the circuit structure 1 shown in FIGS. 1 and 2, so that the similar content is omitted. The differences between the circuit structure 3 and the circuit structure 1 are as following.

In this embodiment, the circuit structure 3 further includes a third conductive layer 36 and an insulating layer 37. The third conductive layer 36 is disposed between the second conductive layer 302 and the second substrate 32. The insulating layer 37 is disposed between the second conductive layer 302 and the third conductive layer 36. The insulating layer 37 may be made of a prepreg material. The insulating layer 37 is further filled between the second conductive layer 302 and the waveguide signal feeding element 33. The ring-shaped conductive element 34 is electrically connected to the third conductive layer 36. Referring to the circuit structure 3, third conductive layer 36 may be grounded. The waveguide signal feeding element 33 passes through the third conductive layer 36 and the insulating layer 37. The waveguide signal feeding element 33 is electrically insulated from the third conductive layer 36. The third conductive layer 36 has an opening 36*a*. The waveguide signal feeding element 33 passes through the opening 36*a*. A dielectric component 340 is filled between the ring-shaped conductive element 34 and the waveguide signal feeding element 33, and is also filled between the third conductive layer 36 and the waveguide signal feeding element 33. However, the dielectric component 340 is not filled between the second conductive layer 302 and the waveguide signal feeding element 33. An inner diameter D1 of an opening 302*a* of the second conductive layer 302 is smaller than an inner diameter D2 of the ring-shaped conductive element 34. An inner diameter D3 of an opening 35*a* of the top conductive layer 35 is smaller than the inner diameter D2 of the ring-shaped conductive element 34. An inner diameter D4 of the opening 36*a* of the third conductive layer 36 is substantially equal to the inner diameter D2 of the ring-shaped conductive element 34.

In this embodiment, the insulating layer 37 has a third dielectric coefficient, and the third dielectric coefficient is different from a first dielectric coefficient of the first substrate 31 and a second dielectric coefficient of the second substrate 32, but the present disclosure is not limited thereto. In some embodiments, the third dielectric coefficient is equal to the first dielectric coefficient and the second dielectric coefficient according to requirements. For example, a waveguide impedance is generated when a signal passes through the substrate integrated waveguide 30, and an equivalent impedance is generated when a signal passes through the waveguide signal feeding element 33 and is fed into the substrate integrated waveguide 30. Referring to the design of the circuit structure 3, a value of the equivalent impedance is adjustable by selecting the insulating layer 37 having suitable third dielectric coefficient. In addition, referring to the design of the circuit structure 3 without changing the sizes of the waveguide signal feeding element 33 and the ring-shaped conductive element 34, a value of the equivalent impedance is adjustable by changing the inner diameter D1 of the opening 302*a* of the second conductive layer 302, the inner diameter D3 of the opening 35*a* of the top conductive layer 35, or the inner diameter D4 of the opening 36*a* of the third conductive layer 36. By adjusting the value of the equivalent impedance to be close to the value of the waveguide impedance, the equivalent impedance matches the waveguide impedance along a path where the signal passes through. Therefore, the signal is prevented from being excessively attenuated or distorted due to impedance mismatch, such that the signal strength and the signal accuracy of the signal transmission of the circuit structure 3 is improved.

When manufacturing the circuit structure 3, the substrate integrated waveguide 30 may be formed by a method the same as a method of forming the substrate integrated waveguide 10 in FIG. 2. Further, the opening 302*a* is formed at the second conductive layer 302 of the substrate integrated waveguide 30. Additionally, a commercially available double-sided copper-clad laminate may be used as the third conductive layer 36, the second substrate 32, and the top conductive layer 35, but the present disclosure is not limited thereto. Next, the ring-shaped conductive element 34 is formed in the second substrate 32. The dielectric component 340 is formed in the ring-shaped conductive element 34 and the opening 36*a* of the third conductive layer 36. The third conductive layer 36 and the second conductive layer 302 of the substrate integrated waveguide 30 are bonded by the insulating layer 37. Further, the waveguide signal feeding element 33 and the filler 330 are formed at a position where the dielectric component 340 is located, and both the waveguide signal feeding element 33 and the filler 330 extend from the second substrate 32 to the first substrate 31. In addition, a range of the top conductive layer 35 may be increased or decreased according to requirements so as to adjust a size of the opening 35*a* of the top conductive layer 35. In this manufacturing method, the substrate integrated waveguide 30 and the configuration including the third conductive layer 36, the second substrate 32, the top conductive layer 35 and the ring-shaped conductive element 34 may be formed simultaneously at different positions; then, the third conductive layer 36 and the substrate integrated waveguide 30 are bonded by the insulating layer 37. Thereby, it is favorable for saving the time required for manufacturing the circuit structure 3.

Figure 6:
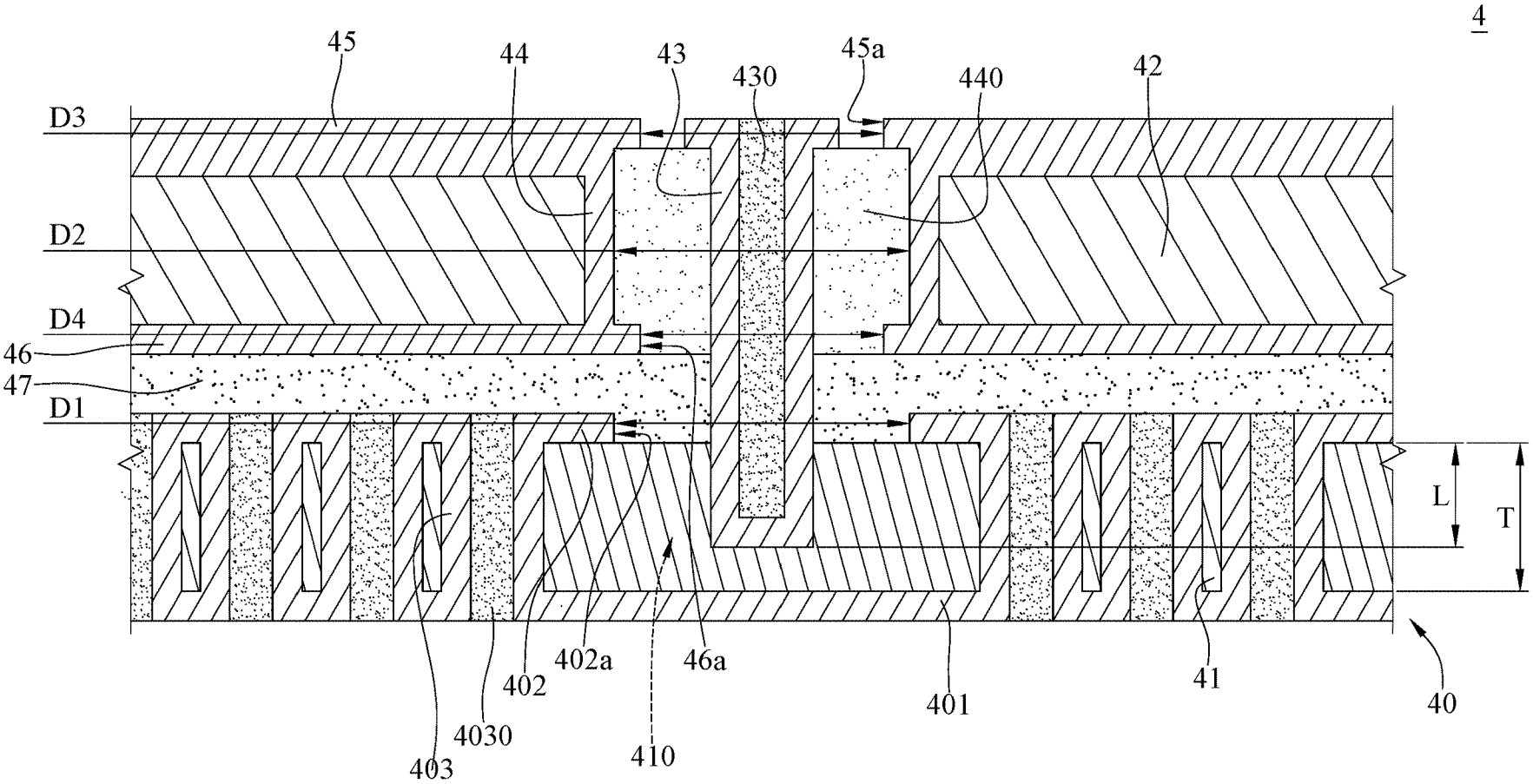
FIG. 6 is a top view of a circuit structure according to another embodiment of the disclosure.

Please refer to FIG. 6, which is a schematic top view of a circuit structure according to another embodiment of the disclosure.

In this embodiment, the circuit structure 4 includes a substrate integrated waveguide 40 having a first substrate 41, a first conductive layer 401, a second conductive layer 402, a plurality of waveguide conductive elements 403, and a plurality of fillers 4030, a second substrate 42, a waveguide signal feeding element 43, a filler 430, a ring-shaped conductive element 44, a dielectric component 440, and a top conductive layer 45. The first substrate 41 has a waveguide transmitting region 410. A portion of the waveguide signal feeding element 43 extending into the first substrate 41 has a length L, and the length L is smaller than a thickness of the first substrate 41. An inner diameter D1 of an opening 402*a* of the second conductive layer 402 is substantially equal to an inner diameter D2 of the ring-shaped conductive element 44.

The circuit structure 4 in this embodiment as mentioned is similar to the circuit structure 1 shown in FIGS. 1 and 2, so that the similar content is omitted. The differences between the circuit structure 4 and the circuit structure 1 are as following.

In this embodiment, the circuit structure 4 further includes a third conductive layer 46 and an insulating layer 47. The third conductive layer 46 is disposed between the second conductive layer 402 and the second substrate 42. The insulating layer 47 is disposed between the second conductive layer 402 and the third conductive layer 46. The insulating layer 47 may be made of a prepreg material. The insulating layer 47 is further filled between the second conductive layer 402 and the waveguide signal feeding element 43. The ring-shaped conductive element 44 is electrically connected to the third conductive layer 46. Referring to the circuit structure 4, the third conductive layer 46 may be grounded. The waveguide signal feeding element 43 passes through the third conductive layer 36 and the insulating layer 47. The waveguide signal feeding element 43 is electrically insulated from the third conductive layer 46. The third conductive layer 46 has an opening 46*a*. The waveguide signal feeding element 43 passes through the opening 46*a*. The dielectric component 440 is filled between the ring-shaped conductive element 44 and the waveguide signal feeding element 43, and is also filled between the third conductive layer 46 and the waveguide signal feeding element 43. However, the dielectric component 440 is not filled between the second conductive layer 402 and the waveguide signal feeding element 43. An inner diameter D3 of an opening 45*a* of the top conductive layer 45 is smaller than the inner diameter D2 of the ring-shaped conductive element 44. An inner diameter D4 of the opening 46*a* of the third conductive layer 46 is smaller than the inner diameter D2 of the ring-shaped conductive element 44.

A waveguide impedance is generated when a signal passes through the substrate integrated waveguide 40, and an equivalent impedance is generated when a signal passes through the waveguide signal feeding element 43 and is fed into the substrate integrated waveguide 40. Referring to the design of the circuit structure 4 without changing the sizes of the waveguide signal feeding element 43 and the ring-shaped conductive element 44, a value of the equivalent impedance is adjustable by changing one or more parameters, such as the inner diameter D1 of the opening 402*a* of the second conductive layer 402, the inner diameter D3 of the opening 45*a* of the top conductive layer 45, and the inner diameter D4 of the opening 46*a* of the third conductive layer 46. By adjusting the value of the equivalent impedance to be close to the value of the waveguide impedance, the equivalent impedance matches the waveguide impedance along a path where the signal passes through. Therefore, the signal is prevented from being excessively attenuated or distorted due to impedance mismatch, such that the signal strength and the signal accuracy of the signal transmission of the circuit structure 4 are improved.

Figure 7:
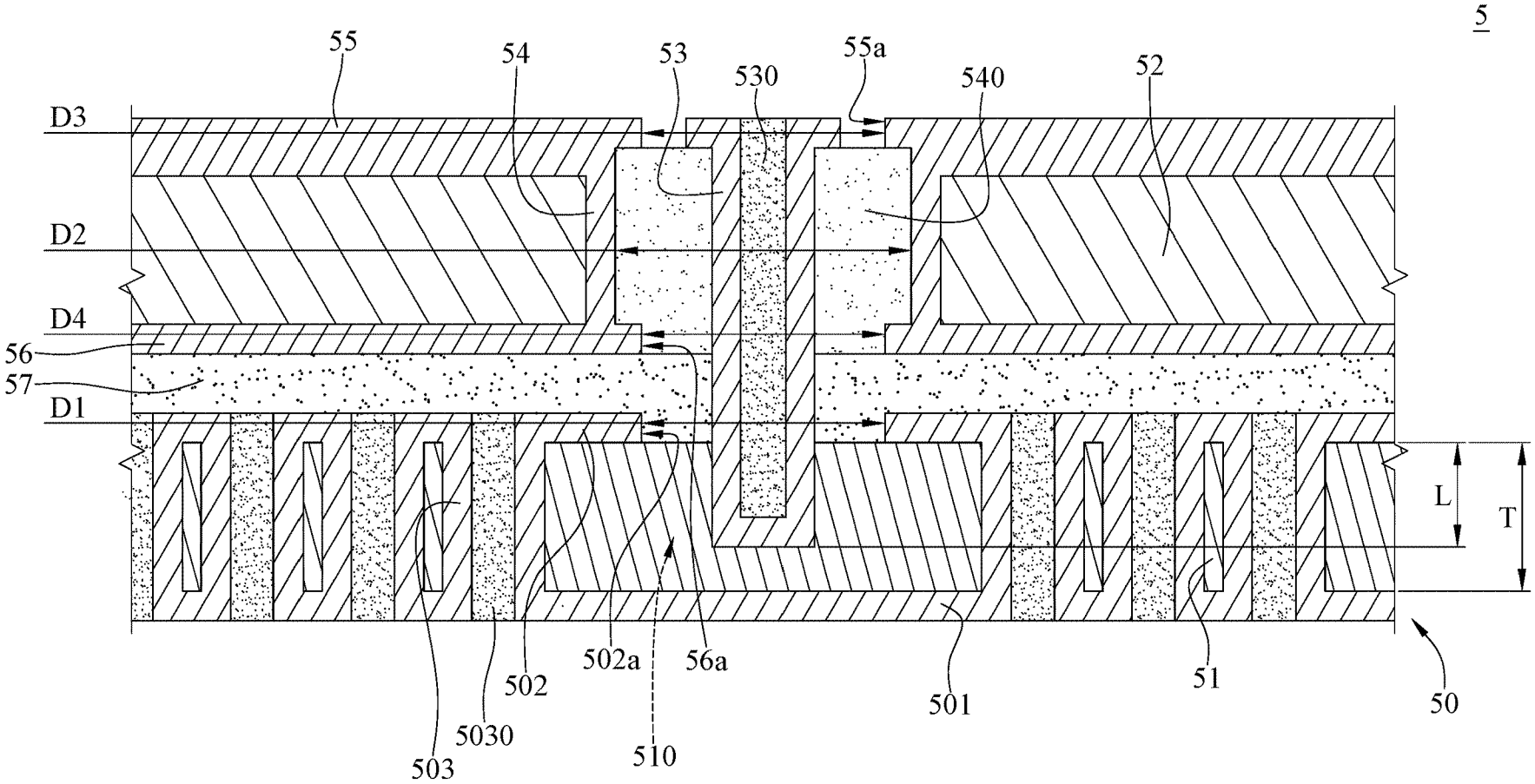
FIG. 7 is a top view of a circuit structure according to another embodiment of the disclosure.

Please refer to FIG. 7, which is a schematic top view of a circuit structure according to another embodiment of the disclosure.

In this embodiment, the circuit structure 5 includes a substrate integrated waveguide 50 having a first substrate 51, a first conductive layer 501, a second conductive layer 502, a plurality of waveguide conductive elements 503, and a plurality of fillers 5030, a second substrate 52, a waveguide signal feeding element 53, a filler 530, a ring-shaped conductive element 54, a dielectric component 540, and a top conductive layer 55. The first substrate 51 has a waveguide transmitting region 510. A portion of the waveguide signal feeding element 53 extending into the first substrate 51 has a length L, and the length L is smaller than a thickness of the first substrate 51.

The circuit structure 5 in this embodiment as mentioned is similar to the circuit structure 1 shown in FIGS. 1 and 2, so that the similar content is omitted. The differences between the circuit structure 5 and the circuit structure 1 are as following.

In this embodiment, the circuit structure 5 further includes a third conductive layer 56 and an insulating layer 57. The third conductive layer 56 is disposed between the second conductive layer 502 and the second substrate 52. The insulating layer 57 is disposed between the second conductive layer 502 and the third conductive layer 56. The insulating layer 57 may be made of a prepreg material. The insulating layer 57 is further filled between the second conductive layer 502 and the waveguide signal feeding element 53. The ring-shaped conductive element 54 is electrically connected to the third conductive layer 56. Referring to the circuit structure 5, the third conductive layer 56 may be grounded. The waveguide signal feeding element 53 passes through the third conductive layer 56 and the insulating layer 57. The waveguide signal feeding element 53 is electrically insulated from the third conductive layer 56. The third conductive layer 56 has an opening 56*a*. The waveguide signal feeding element 53 passes through the opening 56*a*. The dielectric component 540 is filled between the ring-shaped conductive element 54 and the waveguide signal feeding element 53, and is also filled between the third conductive layer 56 and the waveguide signal feeding element 53. However, the dielectric component 440 is not filled between the second conductive layer 502 and the waveguide signal feeding element 53. An inner diameter D1 of an opening 502*a* of the second conductive layer 502 is smaller than an inner diameter D2 of the ring-shaped conductive element 54. An inner diameter D3 of an opening 55*a* of the top conductive layer 55 is smaller than the inner diameter D2 of the ring-shaped conductive element 54. An inner diameter D4 of the opening 56*a* of the third conductive layer 56 is smaller than the inner diameter D2 of the ring-shaped conductive element 54.

A waveguide impedance is generated when a signal passes through the substrate integrated waveguide 50, and an equivalent impedance is generated when a signal passes through the waveguide signal feeding element 53 and is fed into the substrate integrated waveguide 50. Referring to the design of the circuit structure 5 without changing the sizes of the waveguide signal feeding element 53 and the ring-shaped conductive element 54, a value of the equivalent impedance is adjustable by changing one or more parameters, such as the inner diameter D1 of the opening 502*a* of the second conductive layer 502, the inner diameter D3 of the opening 55*a* of the top conductive layer 55, and the inner diameter D4 of the opening 56*a* of the third conductive layer 56. By adjusting the value of the equivalent impedance to be close to the value of the waveguide impedance, the equivalent impedance matches the waveguide impedance along a path where the signal passes through. Therefore, the signal is prevented from being excessively attenuated or distorted due to impedance mismatch, such that the signal strength and the signal accuracy of the signal transmission of the circuit structure 5 are improved.

Figure 8:
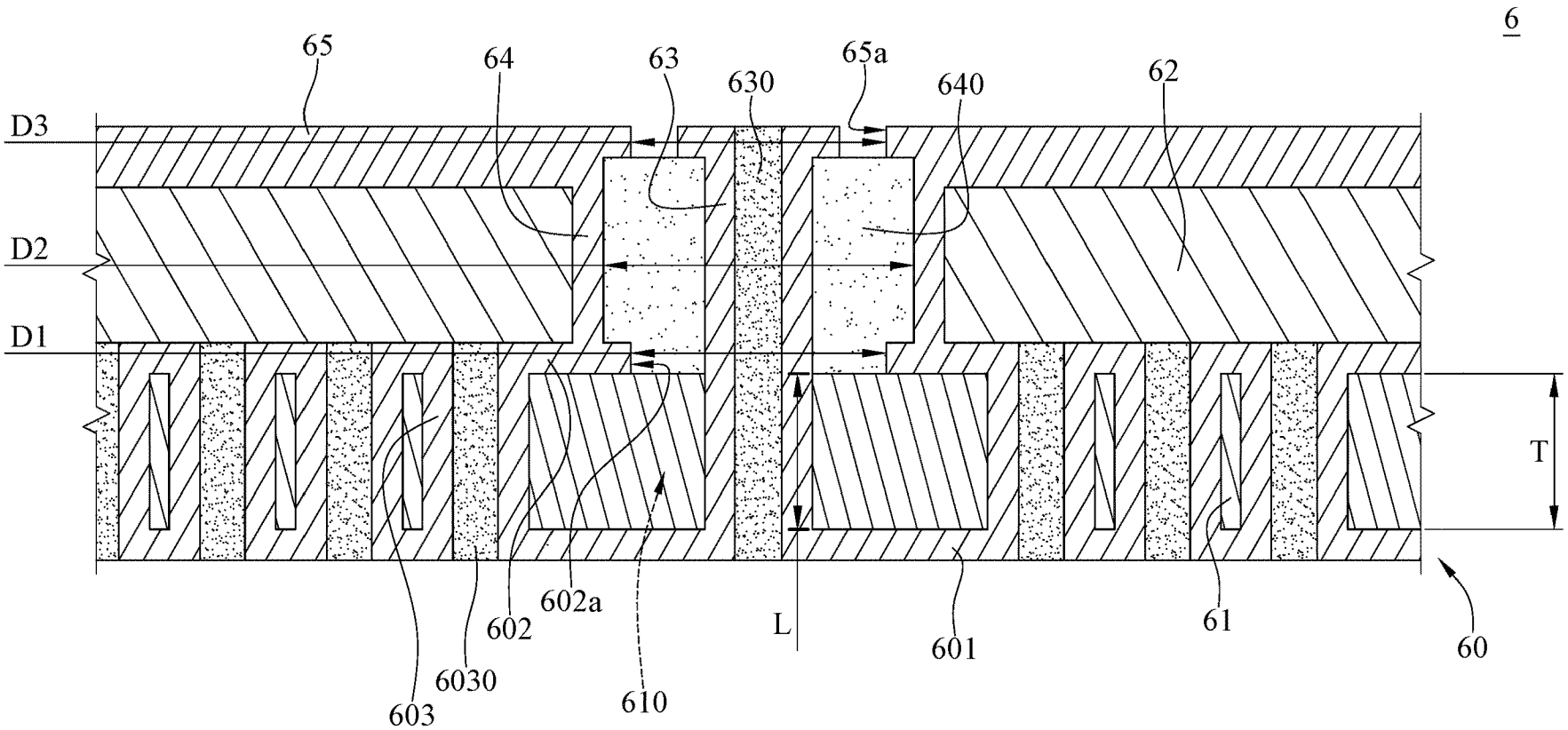
FIG. 8 is a top view of a circuit structure according to another embodiment of the disclosure.

FIG. 8 is a schematic top view of a circuit structure according to another embodiment of the disclosure.

In this embodiment, the circuit structure 6 includes a substrate integrated waveguide 60 having a first substrate 61, a first conductive layer 601, a second conductive layer 602, a plurality of waveguide conductive elements 603, and a plurality of fillers 6030, a second substrate 62, a waveguide signal feeding element 63, a filler 630, a ring-shaped conductive element 64, a dielectric component 640, and a top conductive layer 65. The first substrate 61 has a waveguide transmitting region 610.

The circuit structure 6 in this embodiment as mentioned is similar to the circuit structure 1 shown in FIGS. 1 and 2, so that the similar content is omitted. The differences between the circuit structure 6 and the circuit structure 1 are as following.

In the circuit structure 6 of this embodiment, an inner diameter D1 of an opening 602*a* of the second conductive layer 602 is smaller than an inner diameter D2 of the ring-shaped conductive element 64. An inner diameter D3 of an opening 65*a* of the top conductive layer 65 is smaller than the inner diameter D2 of the ring-shaped conductive element 64. The waveguide signal feeding element 63 passes through the first substrate 61. A portion of the waveguide signal feeding element 63 extending into the first substrate 61 has a length L, and the length L is substantially equal to a thickness of the first substrate 61. Moreover, the waveguide signal feeding element 63 is electrically connected to the first conductive layer 601. Thereby, a bandwidth of a frequency of a signal fed from the waveguide signal feeding member 63 into the substrate integrated waveguide 60 is adjustable.

Figure 9:
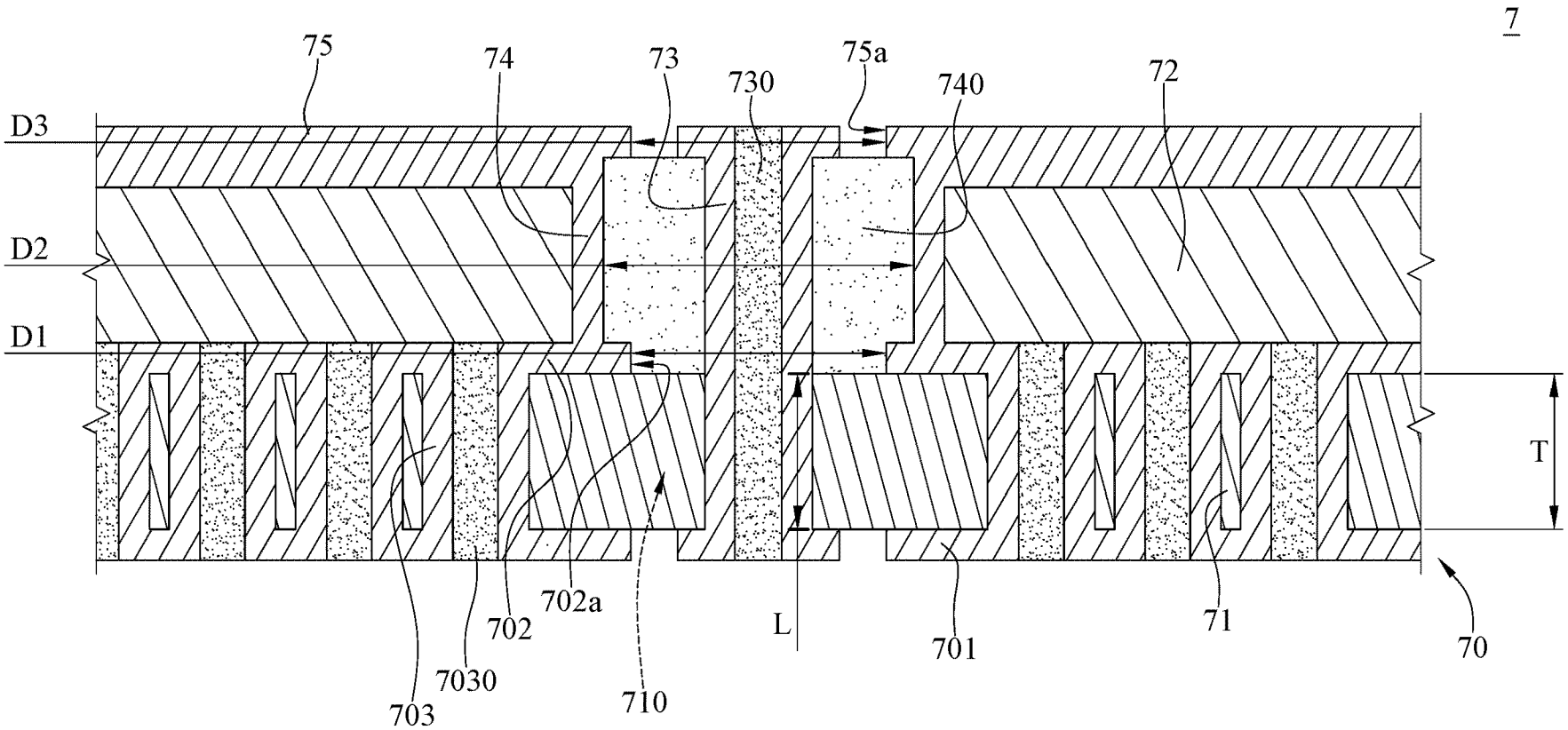
FIG. 9 is a top view of a circuit structure according to another embodiment of the disclosure.

FIG. 9 is a schematic top view of a circuit structure according to another embodiment of the disclosure.

In this embodiment, the circuit structure 7 includes a substrate integrated waveguide 70 having a first substrate 71, a first conductive layer 701, a second conductive layer 702, a plurality of waveguide conductive elements 703, and a plurality of fillers 7030, a second substrate 72, a waveguide signal feeding element 73, a filler 730, a ring-shaped conductive element 74, a dielectric component 740, and a top conductive layer 75. The first substrate 71 has a waveguide transmitting region 710.

The circuit structure 7 in this embodiment as mentioned is similar to the circuit structure 1 shown in FIGS. 1 and 2, so that the similar content is omitted. The differences between the circuit structure 7 and the circuit structure 1 are as following.

In the circuit structure 7 of this embodiment, an inner diameter D1 of an opening 702*a* of the second conductive layer 702 is smaller than an inner diameter D2 of the ring-shaped conductive element 74. An inner diameter D3 of an opening 75*a* of the top conductive layer 75 is smaller than the inner diameter D2 of the ring-shaped conductive element 74. The waveguide signal feeding element 73 passes through the first substrate 71. A portion of the waveguide signal feeding element 73 extending into the first substrate 71 has a length L, and the length L is substantially equal to a thickness of the first substrate 71. Moreover, the waveguide signal feeding element 73 is electrically insulated from the first conductive layer 701.

Figure 10:
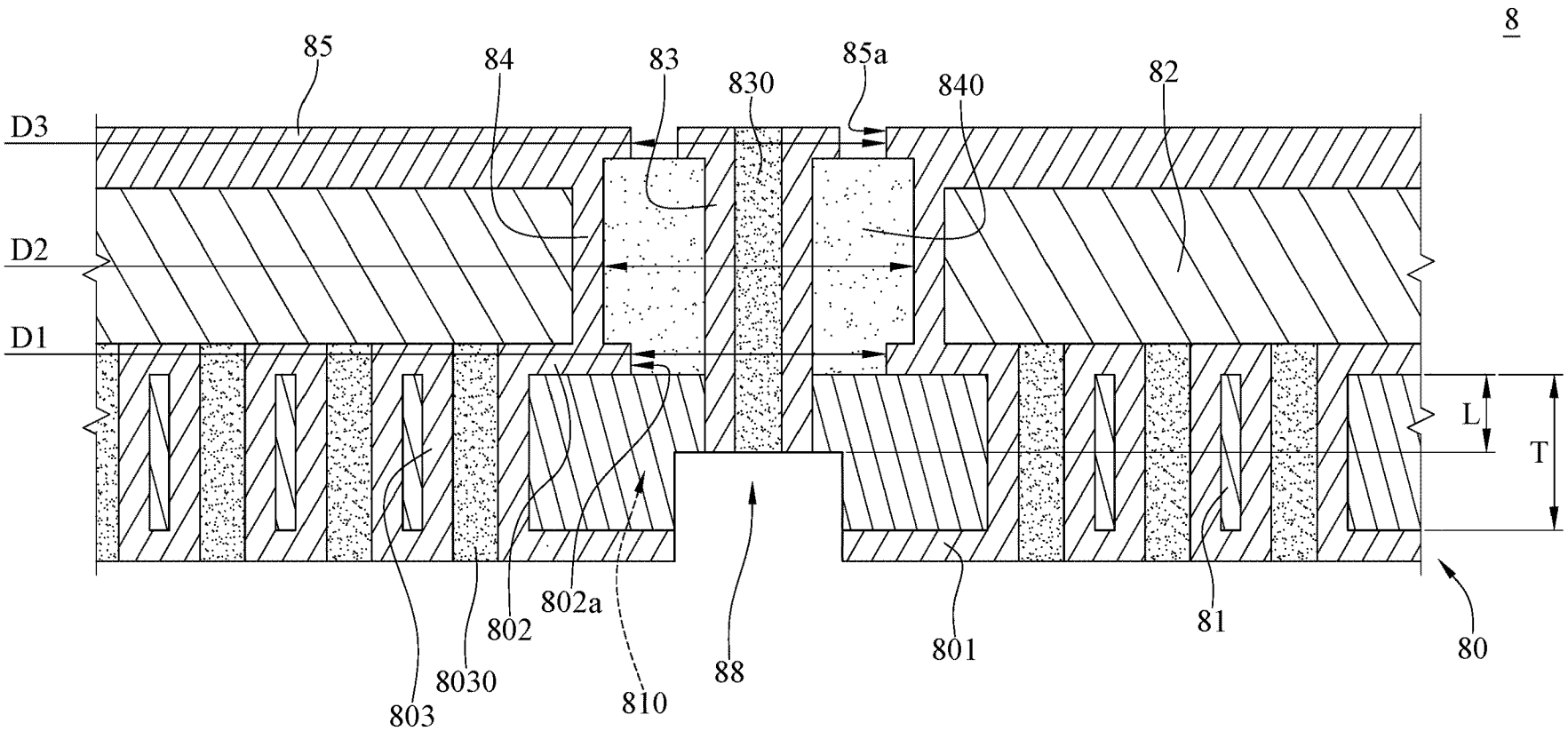
FIG. 10 is a top view of a circuit structure according to another embodiment of the disclosure.

FIG. 10 is a schematic top view of a circuit structure according to another embodiment of the disclosure.

In this embodiment, the circuit structure 8 includes a substrate integrated waveguide 80 having a first substrate 81, a first conductive layer 801, a second conductive layer 802, a plurality of waveguide conductive elements 803, and a plurality of fillers 8030, a second substrate 82, a waveguide signal feeding element 83, a filler 830, a ring-shaped conductive element 84, a dielectric component 840, and a top conductive layer 85. The first substrate 81 has a waveguide transmitting region 810.

The circuit structure 8 in this embodiment as mentioned is similar to the circuit structure 1 shown in FIGS. 1 and 2, so that the similar content is omitted. The differences between the circuit structure 8 and the circuit structure 1 are as following.

In the circuit structure 8 of this embodiment, an inner diameter D1 of an opening 802*a* of the second conductive layer 802 is smaller than an inner diameter D2 of the ring-shaped conductive element 84. An inner diameter D3 of an opening 85*a* of the top conductive layer 85 is smaller than the inner diameter D2 of the ring-shaped conductive element 84. The circuit structure 8 has a recess 88 formed on the first conductive layer 801, and the recess 88 extends toward the second conductive layer 802. The recess 88 passes through a portion of the first substrate 81. Thereby, the waveguide signal feeding element 83 passes through the first substrate 81. However, a portion of the waveguide signal feeding element 83 extending into the first substrate 81 has a length L, and the length L is smaller than a thickness of the first substrate 81. Moreover, the waveguide signal feeding element 83 is electrically insulated from the first conductive layer 801.

According to the circuit structure as discussed above, the ring-shaped conductive element surrounding the waveguide signal feeding element is used to block a signal leaking from the waveguide signal feeding element or to block an external noise interfering the transmitted signal from the waveguide signal feeding element, so as to improve a signal strength and a signal accuracy of a signal transmission of the circuit structure. Further, an equivalent impedance is generated when a signal passes through the waveguide signal feeding element and is fed into the substrate integrated waveguide. Referring to the design of the circuit structure, a value of the equivalent impedance is adjustable by changing one or more parameters, such as the inner diameter of the opening of the second conductive layer, the inner diameter of the opening of the third conductive layer, the inner diameter of the opening of the top conductive layer, the first dielectric coefficient of the first substrate, the second dielectric coefficient of the second substrate, the third dielectric coefficient of the insulating layer, and the dielectric coefficient of the dielectric component in the ring-shaped conductive element. This adjustment makes the equivalent impedance match the waveguide impedance along a path where the signal passes through. Therefore, the signal is prevented from being excessively attenuated or distorted due to impedance mismatch. Further, the signal strength and the signal accuracy of the signal transmission of the circuit structure are improved.

What is claimed is:

1. A circuit structure, comprising:

a substrate integrated waveguide, comprising:

a first substrate having a waveguide transmitting region;

a first conductive layer and a second conductive layer disposed on opposite surfaces of the first substrate, respectively, and covering the waveguide transmitting region; and at least one waveguide conductive element passing through the first substrate and electrically connected to the first conductive layer and the second conductive layer, wherein the at least one waveguide conductive element surrounds the waveguide transmitting region;

a second substrate disposed on the substrate integrated waveguide, wherein the second conductive layer is located between the first substrate and the second substrate;

a waveguide signal feeding element passing through the second substrate and the second conductive layer, the waveguide signal feeding element extending to the waveguide transmitting region of the first substrate, wherein the waveguide signal feeding element is electrically insulated from the second conductive layer; and a ring-shaped conductive element disposed in the second substrate and entirely surrounding the waveguide signal feeding element, wherein the ring-shaped conductive element has an inner surface and an outer surface, each of the inner surface and the outer surface is a continuous surface, and a perimeter of the outer surface is larger than a perimeter of the inner surface, wherein the circuit structure further comprises a third conductive layer and an insulating layer, the third conductive layer is disposed between the second conductive layer and the second substrate, the insulating layer is disposed between the second conductive layer and the third conductive layer, the ring-shaped conductive element is electrically connected to the third conductive layer, the ring-shaped conductive element and the second conductive layer are spaced apart from each other by the insulating layer, the waveguide signal feeding element passes through the third conductive layer and the insulating layer, and the waveguide signal feeding element is electrically insulated from the third conductive layer.

2. The circuit structure according to claim 1, further comprising a top conductive layer disposed on the second substrate, wherein the second substrate is located between the second conductive layer and the top conductive layer, the top conductive layer is electrically connected to the ring-shaped conductive element, and the waveguide signal feeding element is electrically insulated from the top conductive layer.

3. The circuit structure according to claim 2, wherein the top conductive layer has an opening, the waveguide signal feeding element passes through the opening, and an inner diameter of the opening is smaller than an inner diameter of the ring-shaped conductive element.

4. The circuit structure according to claim 1, wherein the second conductive layer has an opening, the waveguide signal feeding element passes through the opening, and an inner diameter of the opening is smaller than an inner diameter of the ring-shaped conductive element.

5. The circuit structure according to claim 1, wherein the third conductive layer has an opening, the waveguide signal feeding element passes through the opening, and an inner diameter of the opening is smaller than an inner diameter of the ring-shaped conductive element.

6. The circuit structure according to claim 1, wherein the first substrate has a first dielectric coefficient, the second substrate has a second dielectric coefficient, the insulating layer has a third dielectric coefficient, and the third dielectric coefficient is different from the first dielectric coefficient and the second dielectric coefficient.

7. The circuit structure according to claim 1, wherein the ring-shaped conductive element is electrically connected to the second conductive layer.

8. The circuit structure according to claim 1, wherein a portion of the waveguide signal feeding element extending into the first substrate has a length smaller than a thickness of the first substrate.

9. The circuit structure according to claim 1, wherein the waveguide signal feeding element passes through the first substrate, and the waveguide signal feeding element is electrically insulated from the first conductive layer.

10. The circuit structure according to claim 1, wherein the waveguide signal feeding element passes through the first substrate, and the waveguide signal feeding element is electrically connected to the first conductive layer.

11. The circuit structure according to claim 1, wherein a quantity of the at least one waveguide conductive element is plural, and the waveguide conductive elements are spaced apart from each other and together surround the waveguide transmitting region.

12. The circuit structure according to claim 1, wherein a quantity of the at least one waveguide conductive element is one, and the waveguide conductive element surrounds the waveguide transmitting region.

13. The circuit structure according to claim 1, wherein the first substrate has a first dielectric coefficient, the second substrate has a second dielectric coefficient, and the first dielectric coefficient is equal to the second dielectric coefficient.

* * * * *